United States Patent [19]

Clarke et al.

[11] Patent Number: 4,487,682

[45] Date of Patent: Dec. 11, 1984

[54] COAL EXTRACTION

[75] Inventors: James W. Clarke, Tewkesbury; Geoffrey M. Kimber; Terry D. Rantell, both of Cheltenham, all of England

[73] Assignee: Coal Industry (Patents) Limited, London, England

[21] Appl. No.: 162,128

[22] Filed: Jun. 23, 1980

[30] Foreign Application Priority Data

Jul. 17, 1979 [GB] United Kingdom ..... 7924935

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS 3,375,188 3/1968 Bloomer ..... 208/8 LE
3,663,420 5/1972 Jacobs et al. ..... 208/8 LE
3,856,675 12/1974 Sze et al. ..... 208/8 LE X
3,954,595 5/1976 Sze et al. ..... 208/8 LE

FOREIGN PATENT DOCUMENTS 314213 6/1929 United Kingdom .
891868 3/1962 United Kingdom .
1499332 2/1978 United Kingdom .

*Primary Examiner*—Delbert E. Gantz
*Assistant Examiner*—William G. Wright
*Attorney, Agent, or Firm*—Stevens, Davis, Miller & Mosher

[57] ABSTRACT

Coal extracts from hydrogenative liquid extraction of coals can be more easily and more quickly filtered if the extraction is carried out at a temperature over 420° C. and the resulting extract is fractionated using a cut point in the range 200° to 300° C. to remove low boiling material. The product is then filtered to give a filtrate containing less than 0.1% by weight of mineral matter.

3 Claims, 1 Drawing Figure

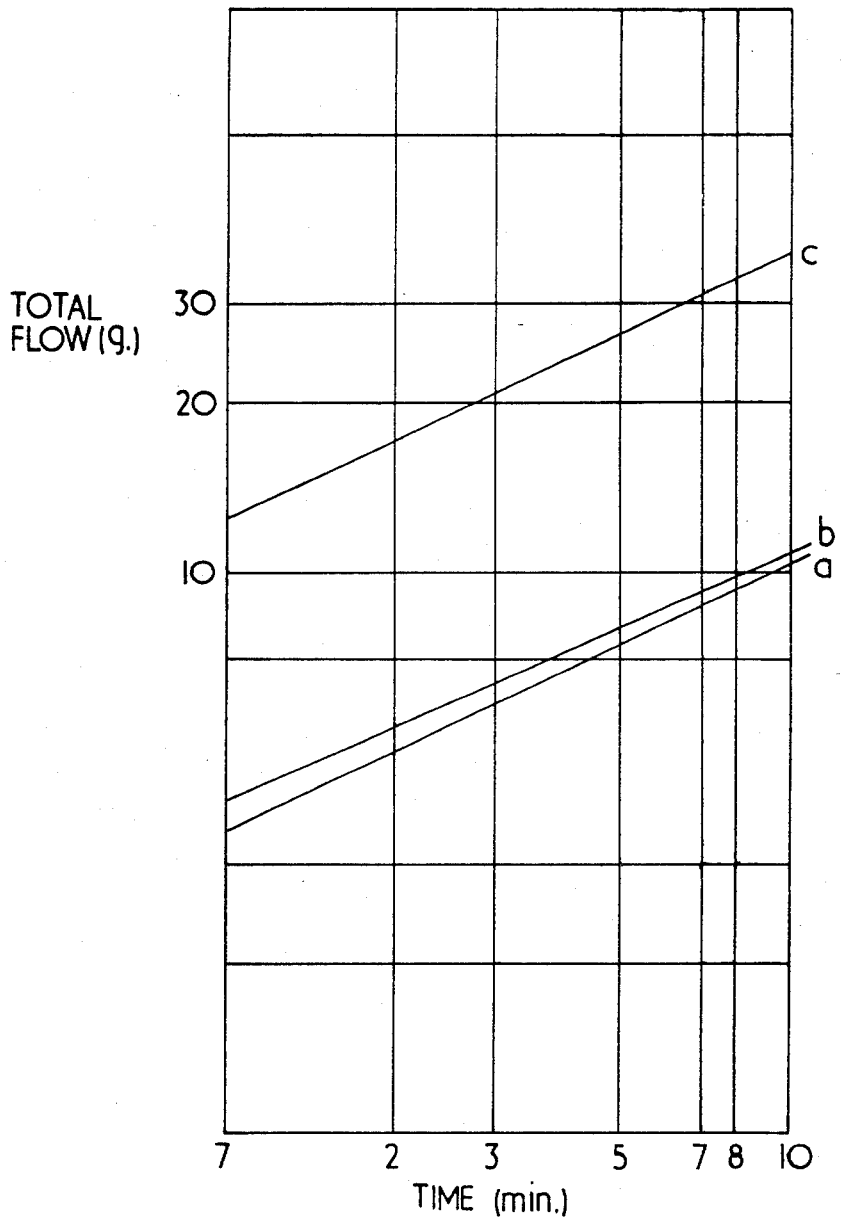
TOTAL FLOW (g.)
30
20
10
c
b
a
7
2
3
5
7
8
10
TIME (min.)

COAL EXTRACTION

This invention concerns the liquefaction of coal, termed hereinafter the extraction of coal, and more particularly concerns the extraction of coal under hydrogenative conditions.

The extraction of coal using a liquid solvent, usually a solvent oil which is derived from coal tar or is a recycle oil from the process, is well known. The extraction is carried out by heating the coal with the solvent usually at temperatures of 350° to 400° C., under pressure to maintain the solvent in the liquid state. Varying amounts of coal substance are taken into solution leaving significant amounts of undissolved coal and mineral matter (ash) in the product. The mineral matter contains inter alia sulphur-rich materials such as iron pyrites and is generally undesirable in the further processing of the coal extract. The separation of the residue is a troublesome step in the entire process and various methods have been suggested including settling, centrifugal separation and filtration. We favour filtration on a cost-effective basis, but on a commercial size coal extraction plant the filters constitute a high proportion of the capital equipment. It is therefore desirable to minimise the number and size of filter units required for efficient operation of the plant. To minimise the total filter area, a fast filtration and short down time are required.

The extraction of coal can be split into two types, hydrogenative and non-hydrogenative. In hydrogenative extraction, hydrogen is present during extraction, although the way in which the hydrogen is supplied may vary. The extraction may be carried out under an over-pressure of hydrogen; it is believed that hydrogen is taken up initially by the solvent oil and is thereafter transferred to radicals caused by rupture of bonds (depolymerisation) in the molecules of coal substance, thus preventing the possibility of recombination of the radicals to form insoluble high molecular weight products. Hydrogenative extraction may also be carried out using initially a hydrogen-rich solvent which acts as a hydrogen donor solvent, of which tetralin is an example. The solvent may be regenerated by hydrogenation in situ in the reactor or after withdrawing solvent from the process, eg. by distillation from the extract after filtration, hydrogenating it and recycling it to the reactor.

It has been found that the filtration of coal extracts made by hydrogenative extraction is in general more difficult than the filtration of coal extracts made without the addition of hydrogen. It is thought that not only does hydrogenative extraction tend to give a high proportion of very small residual particles of submicron size, which are both difficult to filter and give a filter cake of high resistivity because of close packing and low voids, but also the nature of residual particles are such as to make them inherently difficult to filter. It has been proposed to control the size of the residual particles and hence reduce the cake resistivity. British Patent Specification No. 1,490,619 proposes to extract a coal using a hydrogen donor solvent and to control the conditions so that the rate of free radical formation is greater than the rate of radical hydrogenation. That is, the extraction is carried out in the absence of excess hydrogen to induce polymerisation of the dissolved coal, to create a chemical sintering effect between the small particles of ash and undissolved coal. It is estimated that 1–9% of the extractable coal will be required to thus increase particle size and reduce cake resistivity. We believe, however, that a high extraction yield is very important to the economics of coal extraction and accordingly any measure which reduces yield is not desirable.

During the research which led to the present invention, we found that the use of hydrogenated solvents introduces a problem not encountered with non-hydrogenated solvents. After extraction of coal with a hydrogenated solvent, the extract is generally cooled before filtration. Precipitates form on cooling, because the solvent has a relatively low solvent power for large aromatic molecules. Agglomeration of the precipitates can result in an increase in the filtration rate, in confirmation of the proposals above.

Filtration of coal extracts is especially complicated by the nature of the material to be filtered. For example, the filtration temperature controls the packing of the residual solids in the filter cake. Increasing the temperature produces a more densely packed cake and this reduction in voidage inhibits flow through the bed and decreases the filtration rate. In addition, an increase in the temperature reduces the filtrate viscosity which in turn increases the filtration rate. The overall effect of these opposing factors is complex and the outcome depends upon the system being studied.

The present invention provides a method of preparing coal extract by hydrogenative extraction using a liquid solvent, which method comprises extracting coal at a temperature in excess of 420° C., fractionating the extract before filtration to remove low boiling material using a cut point in the range 200° to 300° C. and filtering the product so that the filtrate contains less than 0.1% by weight of mineral matter.

It has been found that the method of the invention reduces the amount of precipitate on cooling coal extract. It has been proposed to add further solvent to coal extracts to reduce the concentration of high molecular weight species and hence reduce viscosity and facilitate filtration. Another proposal has been to add a light solvent to encourage precipitation of adhesive species to create agglomerates which can be more easily separated. It will be seen that the method of the invention is completely contrary to these proposals and by substantially reducing or eliminating precipitation, no significant loss of product yield occurs. Furthermore, in the case in which the filter cake forms the filter medium, for example when using a woven wire mesh screen or the like, which would be probable on an industrial scale if a precipitate forms at a lower temperature than that of the filtration step, some of the precipitate in the cake is redissolved, resulting in breakdown of the cake and subsequent loss of filtrate clarity.

Preferably the extraction is effected at a temperature of 420° to 500° C., most preferably at 425° to 470° C.

The liquid solvent is suitably a hydrogenated tar oil or recycle oil. It is desirable that the solvent used for extraction should contain a high concentration of aromatic structure and a low concentration of polynaphthenes. When recycle oil is used, as would be the case in a plant, these criteria should govern the selection of the solvent processing conditions and the actual cut selected. The extraction may be carried out under an over pressure of hydrogen. The use of a catalyst is not believed necessary.

The reaction conditions may be chosen according to the coal to be extracted. Pressure is applied to maintain the solvent in the liquid state, and the residence time under extraction conditions is dependent upon the temperature, as is well known in the art.

The fractionation of the low boiling material can be carried out during extraction or in a separate step before filtration. A suitable cut point may be, for example, 250° C. or 300° C. The more material that is removed, by increasing the cut point, the higher will be the viscosity of the remaining product.

Filtration may be carried out in conventional manner, using conventional equipment such as plate or candle filters. In general, however, it is preferred to filter at a high temperature, suitably in the range 200° to 300° C., since we have discovered that despite the closer packing of the filter cake with increasing temperature, the filter cake in the method of the invention is less compressible, permitting higher filtration pressures to be used. In addition, of course, increasing the temperature decreases the viscosity of the extract. On the other hand, however, the filtration temperature should not be greater than about 350° C., to avoid prohibitively high capital costs. It will be appreciated that since the invention involves the removal of low boiling material, the quantity of extract to be filtered is less (with a higher solids concentration) and therefore this itself reduces the load on the filter capacity.

The coal may be chosen from a wide range of coals to be optimised on extraction yield, filtration characteristics and cost. The coal to solvent weight ratio may vary from 1:0.5 to 1:5, but is preferably approximately 1:1 to 1:3.

This invention is illustrated by the following examples.

EXAMPLE 1

Coal from Annesley colliery, near Nottingham, England, which is a high volatile, weakly caking bituminous coal classified as CRC 702 in "The Coal Classification System used by the National Coal Board (Revision of 1964)", National Coal Board Scientific Control, London, was admixed with three times its weight of hydrogenated anthracene oil boiling above 250° C. The mixture was stirred while being heated at 430° C. for 60 minutes in a sealed bomb digester to extract the extractable constituents.

After extraction, the product was fractionated in the digester to remove the material boiling below 250° C. The residue was passed through a laboratory filter under various conditions, giving the following results.

| Filtration Conditions | | Filter Cake | |
|---|---|---|---|
| Pressure ($kN\ m^{-2}$) | Temperature (°C.) | Resistivity ($mkg^{-1} \times 10^{10}$) | Cake Compressibility |
| 76 | 200 | 22 | 0.78 |
| 138 | | 29 | |
| 241 | | 54 | |
| 345 | | 63 | |
| 76 | 300 | 4O | 0.52 |
| 138 | | 53 | |
| 241 | | 78 | |
| 345 | | 90 | |

In all cases the filtrate contained less than 0.1% ash, and the overall yield was 90% by weight.

EXAMPLE 2

The filtering characteristics of an extract (A) prepared according to the invention and as described above in Example 1 were compared with those of an extract (B) prepared at 400° C. which was not fractioned but otherwise prepared under identical conditions.

The extracts were filtered through a laboratory filter at 150° C. and at 138 $kN\ m^{-2}$ pressure; essentially identical rates were obtained.

DESCRIPTION OF THE DRAWING

Further samples of the extracts were filtered through the laboratory filter at 138 $kN\ m^{-2}$ pressure and at 300° C. Extract B filtered at a rate very close to that achieved at 150° C., whereas Extract A filtered at a rate 3 times greater. These results are illustrated on the accompanying figure, in which the line "a" is the cumulative flow at 150° C. for both extracts; line "b" is the cumulative flow at 300° C. for Extract B and line "c" is the cumulative flow at 300° C. for Extract A.

In all cases the filtrate contained less than 0.1% ash.

We claim:

1. In the method of preparing coal extract by hydrogenative extraction using a liquid solvent, the improvement comprising extracting coal at a temperature of from 425° to 470° C. to form a slurry, fractionating the extract to remove low boiling material using a cut point in the range of approximately 250° C. to 300° C. and filtering at a temperature in the range 200° to 300° C. the residue boiling above the cut point so that the filtrate contains less than 0.1% by weight of mineral matter, whereby precipitation of components of the extract is avoided in the slurry to be filtered.

2. The method of claim 1, wherein the extract is fractionated using a cut point of approximately 250° C.

3. The method according to claim 1, wherein the extraction is carried out using a weight ratio of coal to solvent of from 1:1 to 1:3.

* * * * *